US007877858B2

(12) United States Patent
Harel

(10) Patent No.: US 7,877,858 B2
(45) Date of Patent: Feb. 1, 2011

(54) METHOD OF MANUFACTURING A MULTI-LAYER CONDUCTIVE TUBE ANTENNA

(75) Inventor: Sharon Harel, Tiberias (IL)

(73) Assignee: Galtronics Ltd., Tiberias (IL)

( * ) Notice: Subject to any disclaimer, the term of this patent is extended or adjusted under 35 U.S.C. 154(b) by 282 days.

(21) Appl. No.: 12/129,017

(22) Filed: May 29, 2008

(65) Prior Publication Data

US 2009/0077790 A1 Mar. 26, 2009

Related U.S. Application Data

(60) Provisional application No. 60/994,950, filed on Sep. 20, 2007.

(51) Int. Cl.
*H01P 11/00* (2006.01)

(52) U.S. Cl. ..... 29/600; 29/592.1; 29/825; 29/33 R; 343/895; 343/890

(58) Field of Classification Search ..... 29/825, 29/830, 831, 868, 600; 343/895, 741–742, 343/866, 867; 174/102 R, 103, 105 R–108; 385/101, 100, 106–113
See application file for complete search history.

(56) References Cited

U.S. PATENT DOCUMENTS

| | | | | |
|---|---|---|---|---|
| 1,745,096 | A * | 1/1930 | Jayne | 455/270 |
| 4,432,193 | A | 2/1984 | Maki | |
| 4,640,576 | A * | 2/1987 | Eastwood et al. | 226/7 |
| 5,815,908 | A * | 10/1998 | Wichmann | 29/600 |
| 6,788,271 | B1 * | 9/2004 | Koo et al. | 343/895 |
| 6,960,724 | B2 * | 11/2005 | Orlet et al. | 174/102 R |
| 7,023,400 | B2 * | 4/2006 | Hill | 343/874 |
| 7,200,307 | B2 * | 4/2007 | Bau' et al. | 385/111 |

FOREIGN PATENT DOCUMENTS

| | | |
|---|---|---|
| JP | 09 101439 | 4/1997 |
| JP | 11 023910 | 1/1999 |

* cited by examiner

*Primary Examiner*—Minh Trinh
(74) *Attorney, Agent, or Firm*—Weingarten, Schurgin, Gagnebin & Lebovici LLP

(57) ABSTRACT

A method of manufacturing an antenna including providing a dielectric core which does not contain an electrical conductor, forming a layer of an electrically conductive material on the core and providing an electrically insulative tube over the core and over the layer of the electrically conductive material.

4 Claims, 4 Drawing Sheets

METHOD OF MANUFACTURING A MULTI-LAYER CONDUCTIVE TUBE ANTENNA

REFERENCE TO RELATED APPLICATIONS

Reference is made to U.S. Provisional Patent Application Ser. No. 60/994,950, filed Sep. 20, 2007 and entitled "MULTI-LAYER CONDUCTIVE TUBE ANTENNA," the disclosure of which is hereby incorporated by reference and priority of which is hereby claimed pursuant to 37 CFR 1.78 (a) (4) and (5)(i).

FIELD OF THE INVENTION

The present invention relates to antennas and methods of manufacture thereof.

BACKGROUND OF THE INVENTION

The following U.S. patent publications are believed to represent the current state of the art: U.S. Pat. No. 1,745,096.

SUMMARY OF THE INVENTION

The present invention seeks to provide an improved antenna and method for manufacture thereof.

There is thus provided in accordance with a preferred embodiment of the present invention a method of manufacturing an antenna including providing a dielectric core which does not contain an electrical conductor, forming a layer of an electrically conductive material on the core and providing an electrically insulative tube over the core and over the layer of the electrically conductive material.

Preferably, the forming includes winding the layer of an electrically conductive material about the core in a manner such that adjacent turns of the electrically conductive material are spaced from each other.

In accordance with a preferred embodiment, the forming includes wrapping the layer of an electrically conductive material about the core in a manner such that adjacent turns of the electrically conductive material partially overlap each other without touching each other at mutually overlapping regions thereof. Additionally, the winding the layer of an electrically conductive material about the core in a manner such that adjacent turns of the electrically conductive material partially overlap each other without touching each other at mutually overlapping regions thereof includes wrapping an insulatively backed conductive strip about the core in a manner such that adjacent turns of the electrically conductive material partially overlap each other without touching each other at mutually overlapping regions thereof due to the presence therebetween of the strip of electrically insulative material.

Preferably, the method also includes winding an additional layer of an electrically conductive material about the electrically insulative tube in a manner such that adjacent turns of the electrically conductive material are spaced from each other, extruding an electrically insulative outer tube over the core and over the layer of the electrically conductive material, the electrically insulative tube and the additional layer of the electrically conductive material and providing a galvanic connection between the layer of the electrically conductive material and the additional layer of an electrically conductive material.

In accordance with a preferred embodiment of the present invention the method also includes winding an additional layer of an electrically conductive material about the electrically insulative tube in a manner such that adjacent turns of the electrically conductive material are spaced from each other, extruding an electrically insulative outer tube over the core and over the layer of the electrically conductive material, the electrically insulative tube and the additional layer of the electrically conductive material and providing a parasitic connection between the layer of the electrically conductive material and the additional layer of an electrically conductive material.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
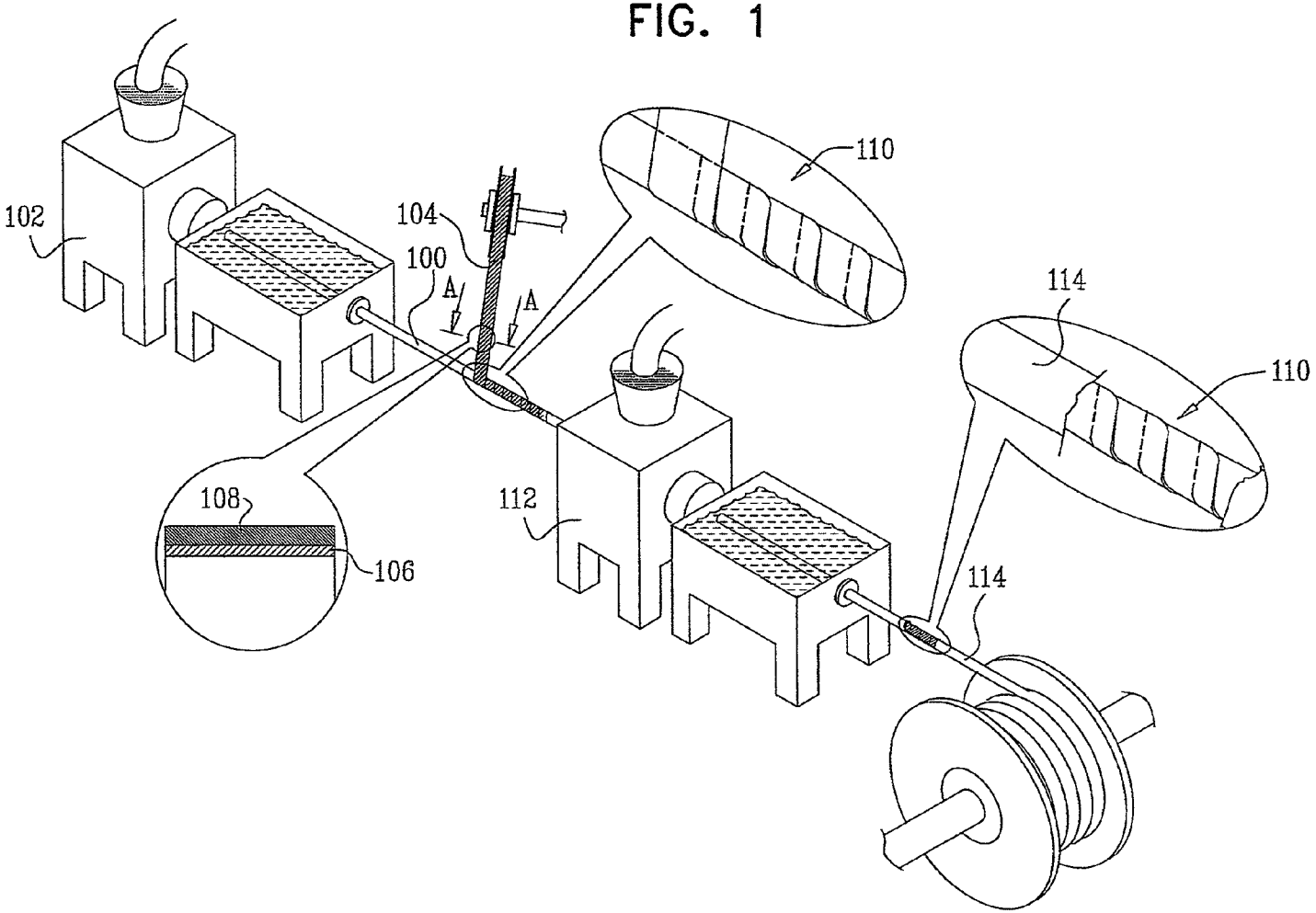
FIG. 1 is a simplified, partially pictorial illustration of a method of manufacture of an antenna in accordance with one preferred embodiment of the present invention.
Figure 2:
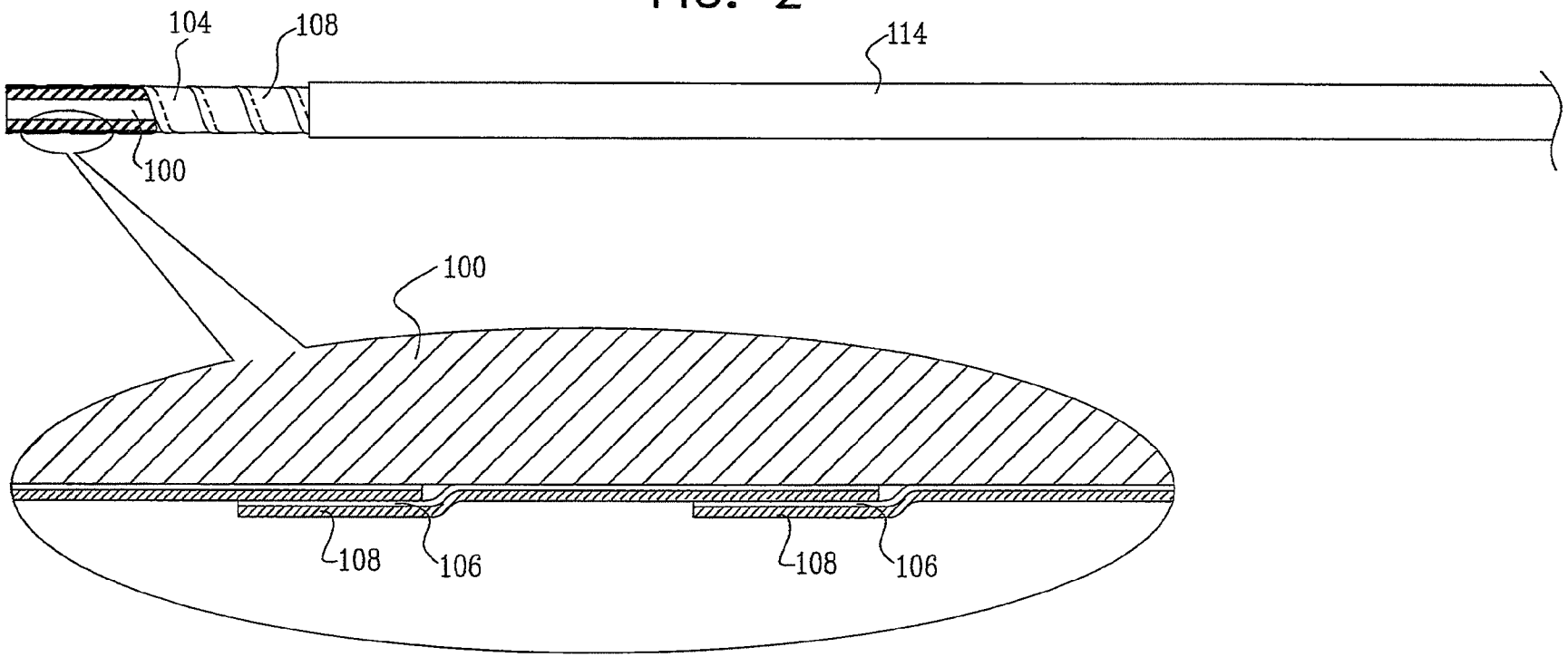
FIG. 2 is a simplified, partially cut away illustration of an antenna body manufactured in accordance with the method of FIG. 1.

Reference is now made to FIG. 1, which is a simplified, partially pictorial illustration of a method of manufacture of an antenna in accordance with one preferred embodiment of the present invention, and to FIG. 2, which illustrates an antenna body manufactured in accordance with the method of FIG. 1. As seen in FIG. 1, a plastic core 100, preferably hollow, is extruded from a suitable dielectric material, such as Santoprene®, by a conventional extruder 102.

The plastic core 100 is cooled and allowed to harden and is then wrapped by winding thereover a tape 104, preferably including an adhesive-backed, electrically insulative underlayer 106, preferably formed of polyester of thickness 12 μm and of width 6 mm, and an electrically conductive top layer 108, preferably formed of copper, of thickness 25 μm and width 6 mm.

The winding is preferably carried out so that adjacent turns of the tape are overlapped to an extent of approximately 25%, as seen with clarity in the enlarged portion of FIG. 2.

The wrapped core, here designated by reference numeral 110, is fed to a suitable extruder 112 which extrudes an electrically insulative tube 114 over the wrapped core 110.

It is noted that extruded plastic core 100, which is preferably hollow, may alternatively be solid dielectric. Although a conductor may be subsequently located within a hollow portion of core 100, the core 102 is not extruded over a conductor.

It is appreciated that due to the provision of the electrically insulative underlayer 106, adjacent turns of the electrically conductive layer 108 do not touch each other at mutually overlapping regions thereof.

Figure 3:
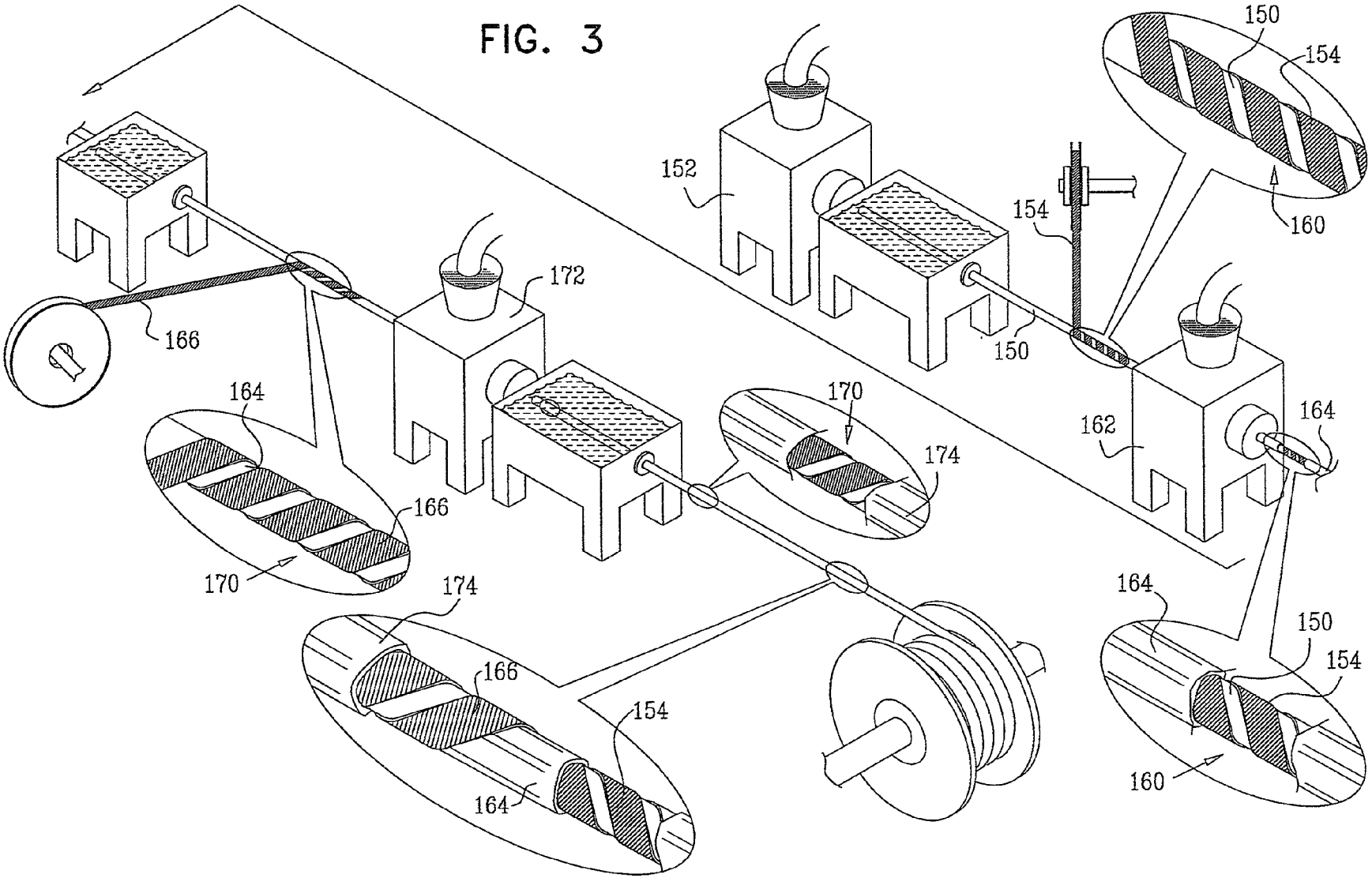
FIG. 3 is a simplified, partially pictorial illustration of a method of manufacture of an antenna in accordance with another preferred embodiment of the present invention.
Figure 4:
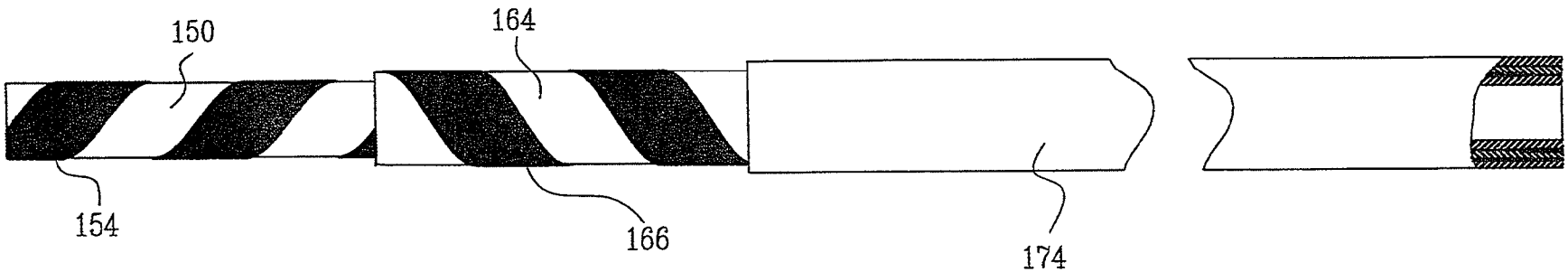
FIG. 4 is a simplified, partially cut away illustration of an antenna body manufactured in accordance with the method of FIG. 3.

Reference is now made to FIG. 3, which is a simplified, partially pictorial illustration of a method of manufacture of an antenna in accordance with one preferred embodiment of the present invention, and to FIG. 4, which illustrates an antenna body manufactured in accordance with the method of FIG. 3. As seen in FIG. 3, a plastic core 150, preferably hollow, is extruded from a suitable dielectric material, such as Santoprene®, by a conventional extruder 152.

The plastic core 150 is cooled and allowed to harden and is then wound with a tape 154, preferably formed of copper, of thickness 25 μm and width 6 mm.

The winding is preferably carried out so that adjacent turns of the tape 154 do not overlap.

The wound core, here designated by reference numeral 160, is fed to a suitable extruder 162 which extrudes an electrically insulative tube 164 over the wound core 110. A tape 166 is then wound over electrically insulative tube 164, preferably in a sense opposite to the winding of tape 154. The winding is preferably carried out so that adjacent turns of the tape 166 do not overlap.

The double wound core, here designated by reference numeral 170, is fed to a suitable extruder 172 which extrudes an electrically insulative tube 174 over the double wound core 170.

It is noted that extruded plastic core 150, which is preferably hollow, may alternatively be solid dielectric. Although a conductor may be subsequently located within a hollow portion of core 150, the core 150 is not extruded over a conductor.

A galvanic or parasitic interconnection (not shown) between electrically conductive tapes 154 and 166 is preferably provided.

In all of the embodiments described hereinabove, a suitable antenna feed connection (not shown) is preferably coupled to the electrically conductive winding at a first end thereof.

It will be appreciated by persons skilled in the art that the present invention is not limited by what has been particularly shown and described hereinabove. Rather the scope of the present invention includes both combinations and subcombinations of features recited in the claims as well as modifications thereof which would occur to a person of ordinary skill in the art upon reading the foregoing and which are not in the prior art.

The invention claimed is:

1. A method of manufacturing an antenna comprising:

providing a dielectric core which does not contain an electrical conductor;

wrapping a layer of an electrically conductive material about said core in a manner such that adjacent turns of said electrically conductive material partially overlap each other without touching each other at mutually overlapping regions thereof; and providing an electrically insulative tube over said core and over said layer of said electrically conductive material.

2. The method of manufacturing an antenna according to claim 1 and wherein said wrapping said layer of an electrically conductive material about said core in a manner such that adjacent turns of said electrically conductive material partially overlap each other without touching each other at mutually overlapping regions thereof comprises:

wrapping an insulatively backed conductive strip about said core in a manner such that adjacent turns of said electrically conductive material partially overlap each other without touching each other at mutually overlapping regions thereof due to the presence therebetween of said strip of electrically insulative material.

3. A method of manufacturing an antenna comprising:

providing a dielectric core which does not contain an electrical conductor;

winding a layer of an electrically conductive material about said core in a manner such that adjacent turns of said electrically conductive material are spaced from each other;

providing an electrically insulative tube over said core and over said layer of said electrically conductive material;

winding an additional layer of an electrically conductive material about said electrically insulative tube in a manner such that adjacent turns of said electrically conductive material are spaced from each other;

extruding an electrically insulative outer tube over said core and over said layer of said electrically conductive material, said electrically insulative tube and said additional layer of said electrically conductive material; and providing a galvanic connection between said layer of said electrically conductive material and said additional layer of an electrically conductive material.

4. A method of manufacturing an antenna comprising:

providing a dielectric core which does not contain an electrical conductor;

winding a layer of an electrically conductive material about said core in a manner such that adjacent turns of said electrically conductive material are spaced from each other;

providing an electrically insulative tube over said core and over said layer of said electrically conductive material;

winding an additional layer of an electrically conductive material about said electrically insulative tube in a manner such that adjacent turns of said electrically conductive material are spaced from each other;

extruding an electrically insulative outer tube over said core and over said layer of said electrically conductive material, said electrically insulative tube and said additional layer of said electrically conductive material; and providing a parasitic connection between said layer of said electrically conductive material and said additional layer of an electrically conductive material.

* * * * *